US010337806B2

(12) United States Patent
Rigaudie et al.

(10) Patent No.: US 10,337,806 B2
(45) Date of Patent: Jul. 2, 2019

(54) FIN PLATE, FRAME COMPRISING AT LEAST ONE SUCH PLATE AND HEAT EXCHANGER COMPRISING SAID FRAME

(71) Applicant: Parker Hannifin Manufacturing France SAS, Annemasse (FR)

(72) Inventors: Erick Rigaudie, Maillet (FR); Nicolas Galmiche, Jiangsu (CN); Damien Burato, Jiangsu (CN)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 14/433,687

(22) PCT Filed: Oct. 4, 2012

(86) PCT No.: PCT/FR2012/052254

§ 371 (c)(1),
(2) Date: Apr. 6, 2015

(87) PCT Pub. No.: WO2014/053712

PCT Pub. Date: Apr. 10, 2014

(65) Prior Publication Data

US 2015/0276330 A1 Oct. 1, 2015

(51) Int. Cl.
*F28D 1/03* (2006.01)
*F28F 3/06* (2006.01)
(Continued)

(52) U.S. Cl.
CPC ..... *F28F 3/02* (2013.01); *F28F 3/027* (2013.01); *F28F 3/046* (2013.01); *F28D 1/0233* (2013.01);
(Continued)

(58) Field of Classification Search
CPC .... F28F 3/02; F28F 3/027; F28F 3/046; F28F 3/06; F28F 2215/08; F28D 1/0233; F28D 1/0366; F28D 9/0062
(Continued)

(56) References Cited

U.S. PATENT DOCUMENTS 1,899,080 A * 2/1933 Dalgliesh ..... F28D 9/0031 165/166
2,632,633 A * 3/1953 Hammond ..... F28F 3/02 165/166
(Continued)

FOREIGN PATENT DOCUMENTS

DE 36 32 666 C1 1/1988
DE 3632666 C1 * 1/1988 ..... F28D 1/0308
(Continued)

OTHER PUBLICATIONS

International Search Report for corresponding patent application No. PCT/FR2012/052254 dated Jun. 12, 2013.

*Primary Examiner* — Leonard R Leo
(74) *Attorney, Agent, or Firm* — Renner, Otto, Boisselle & Sklar, LLP

(57) ABSTRACT

A finned plate 20 comprises a base 22 and a plurality of heat exchange fins 30 extending from said base, said fins 30 being arranged in mutually parallel strips 34 of fins. According to the invention, two adjacent strips 34 of fins are spaced apart in a direction perpendicular to the direction of said strips of fins by at least one flat strip not having any fins 32. Two finned plates 20 of this type can be assembled together to form a frame, in particular a frame that is suitable for being incorporated in a heat exchanger.

11 Claims, 10 Drawing Sheets

(51) Int. Cl.

| | |
|---|---|
| ***F28F 3/02*** | (2006.01) |
| ***F28F 3/04*** | (2006.01) |
| *F28D 9/00* | (2006.01) |
| *F28D 1/02* | (2006.01) |

(52) U.S. Cl.
CPC ..... *F28D 1/0366* (2013.01); *F28D 9/0062* (2013.01); *F28F 3/06* (2013.01); *F28F 2215/08* (2013.01)

(58) Field of Classification Search
USPC ..... 165/152, 153, 166, 157, 165, 170, 185
See application file for complete search history.

(56) References Cited

U.S. PATENT DOCUMENTS 2,656,160 A * 10/1953 Lyerly ..... F28F 3/02 165/166
2,985,434 A * 5/1961 Boring ..... F28F 3/02 165/166
2,988,336 A * 6/1961 Woolard ..... F28F 3/02 165/166
3,083,662 A * 4/1963 Zeidler ..... B21D 53/02 138/38
3,524,497 A * 8/1970 Chu ..... H01L 23/473 165/185
4,657,072 A * 4/1987 Mulock-Bentley ..... F28F 3/042 165/165
5,689,881 A 11/1997 Kato
5,829,514 A * 11/1998 Smith ..... F28F 3/022 165/185
6,273,183 B1 8/2001 So et al.
2004/0177668 A1 9/2004 Sagasser et al.

FOREIGN PATENT DOCUMENTS

JP H07 265985 A 10/1995
JP H09 296989 A 11/1997

* cited by examiner

FIN PLATE, FRAME COMPRISING AT LEAST ONE SUCH PLATE AND HEAT EXCHANGER COMPRISING SAID FRAME

TECHNICAL FIELD

The present invention relates to the field of heat exchangers.

More particularly, it relates to a finned plate, to a frame comprising at least one such finned plate, and to a heat exchanger comprising such a frame.

BACKGROUND OF THE INVENTION

Presently-known heat exchangers are constituted by a stack of heat exchange modules, each module 910 comprising a flow cell 912 for a fluid F1 that is to be cooled, in particular a liquid, and a flow cell 914 for a cooling fluid F2, e.g. a gas and in particular air, the two cells being thermally coupled together. One such heat exchange module is shown in FIG. 1.

In order to increase its heat exchange area so as to increase the efficiency of heat exchange with the cooling fluid, the flow cell for the fluid that is to be cooled comprises a plate 916 having a plurality of fins 918 of substantially rectangular profile arranged in parallel strips that are side-by-side to one another in a direction perpendicular to the direction of said strips.

Such a finned plate is far from providing satisfactory efficiency. In the context of present environmental concerns, it is necessary, amongst other things, to improve the energy efficiency of equipment, and in particular of heat exchangers, while not increasing their cost, nor the quantity of materials used for fabricating them.

OBJECT AND SUMMARY OF THE INVENTION

The present invention thus seeks to propose a heat exchanger of good energy and thermal performance that requires the use of a small quantity of materials for fabrication, and that is also inexpensive.

In a first aspect, the invention provides a finned plate comprising a base and a plurality of heat exchange fins extending from said base, said fins being distributed over at least two mutually parallel strips of fins, and characterized in that said two adjacent strips of fins are separated in a direction perpendicular to the direction of said strips of fins by a flat strip not having any fins.

In a second aspect, the invention also provides a frame, in particular a frame suitable for being incorporated in a heat exchanger, which frame comprises two finned plates as defined above that are nested together in such a manner that the fins of the first finned plate are inserted in facing spaces of said flat strips of the second finned plate and are arranged head-to-toe relative to the adjacent fins of the second finned plate.

Throughout the present application, the lateral direction of a finned plate is defined as being the direction in which the strips of fins of the finned plate extend.

In the same manner, the longitudinal direction of a finned plate is defined as being the direction that is both perpendicular to said lateral direction and parallel to the plane of the base of the finned plate, which is also referred to as a "base plane".

Finally, the transverse direction of the finned plate is defined as being the direction perpendicular to the base plane.

Unless specified to the contrary, throughout the present application, a length relating to a finned plate or to a portion of a finned plate is measured in the longitudinal direction, a width is measured in the lateral direction, and a thickness or a height is measured in the transverse direction.

In a finned plate as defined above, a flat strip between two strips of fins that are adjacent in a direction perpendicular to the direction of said strips of fins is defined as a strip having no fins extending in the plane of the base.

In an advantageous embodiment of the invention, such a flat strip presents a width that is not less than the width of a strip of fins.

Generally, the width of the various strips of fins in a given finned plate are indeed identical.

Also generally, each flat strip extends over the entire length of the strips of fins.

In a provision of the invention, a finned plate as defined above may be formed as a single piece or as a plurality of segments that are assembled or arranged one after another.

In a provision of the invention, each fin has two distinct ends secured to the base, the fin portion defined between said ends being a continuous single piece that does not coincide with said base. It can be understood that the lateral direction of a finned plate is generally parallel to the direction in which the two ends of a given fin are aligned.

In an example, the base has openings between the respective ends of each fin.

In an advantageous provision of the invention, each heat exchange fin includes at least one curved portion or at least one sloping portion sloping relative to the base. In other words, each fin has at least one portion that is neither parallel nor perpendicular to the base plane of the finned plate.

In preferred manner, the fin presents two sloping or curved portions that slope in opposite directions, extending from the base of the finned plate. Such a configuration imparts a certain amount of springiness or flexibility to the fin in the transverse direction of the finned plate. It has been shown that such flexibility of the fins enables a smaller quantity of material to be used than in the prior art, since the plate used for making the finned plate of the invention can be of smaller thickness. This provision thus also presents advantages in environmental and economic terms.

In an embodiment, each fin presents a trapezoidal profile without any right angles. Each side of the trapezoid may for example slope relative to the base plane at an angle lying in the range 20° to 70°, and preferably equal to 45°. Nevertheless, this example is not limiting, and the fins may present any other shape giving them a degree of springiness in the transverse direction, and in particular shapes that are partially or entirely curved.

Preferably, each fin presents a plane of symmetry perpendicular to the lateral direction of the finned plate including said fin.

Advantageously, two adjacent fins of two adjacent strips of fins are offset relative to each other in the direction of said strips of fins. For this purpose, two adjacent strips of fins may for example be offset relative to each other in the direction of said strips (i.e. the lateral direction).

The value of the offset of the fins encountered by the fluid serves to improve heat exchange.

In a first example, two adjacent strips of fins are separated by a continuous flat strip extending over the entire length of said strips of fins.

In a second example, two adjacent strips of fins are separated by a discontinuous flat strip formed by a succession of segments spaced apart by openings. Each flat strip segment is preferably associated with and attached to a respective fin of an adjacent fin strip.

In the first example, the base is a metal plate in which the fins are made by embossing and cutting.

In a second example, the base is a metal plate in which the fins are made by cutting and folding. With this method, the thickness of the plate remains substantially constant.

In an example, in the frame of the invention, two adjacent strips of fins belonging respectively to the two finned plates are offset relative to each other in the direction of said strips of fins.

In an example, two fin portions having the same orientation are in alignment in a direction perpendicular to the strips of fins and parallel to the bases of the finned plates (i.e. in the longitudinal direction), once every K strips of fins, where K is an integer greater than 2, and preferably equal to 4.

K corresponds to that which is referred to below as the periodicity, i.e. the frequency of appearance in the longitudinal direction Y.

Unless specified to the contrary, the offset is considered below in the lateral direction.

The periodicity and the value of the offset of the fins encountered by the fluid flowing through the frame serves to obtain good heat exchange.

In a third aspect, the invention also provides a heat exchanger comprising a stack of heat exchange modules, each module having a flow cell for a fluid that is to be cooled and a flow cell for a cooling fluid, the modules being side by side and thermally coupled together, the flow cell for the fluid that is to be cooled and/or the flow cell for the cooling fluid comprising a frame as defined above.

In an example, in order to provide sealing, each flow cell housing a frame has at least two spacers, each having first and second opposite parallel bearing faces adapted to come into contact with the respective bases of the two finned plates of said frame.

In an example, the distance between the two bearing faces of each spacer is less than the height of the heat exchange fins. When the frame is mounted between two separator plates that are spaced apart from each other by said spacers, the fins are deformed elastically as a result of their relative flexibility in the transverse direction so as to provide permanent contact with said separator plates and thus effective heat exchange.

Several embodiments and implementations are described in the present description. Nevertheless, unless specified to the contrary, characteristics described with reference to any one embodiment or implementation may be applied to any other embodiment or implementation.

BRIEF DESCRIPTION OF THE DRAWINGS

The invention can be well understood and its advantages appear better on reading the following detailed description of several embodiments given as non-limiting examples. The description refers to the accompanying drawings, in which:

FIGS. 7A and 7B show a frame in a first embodiment of the invention, seen edge on;

FIG. 12 shows the FIG. 11 frame seen edge on.

DETAILED DESCRIPTION OF EMBODIMENTS

Figure 1:
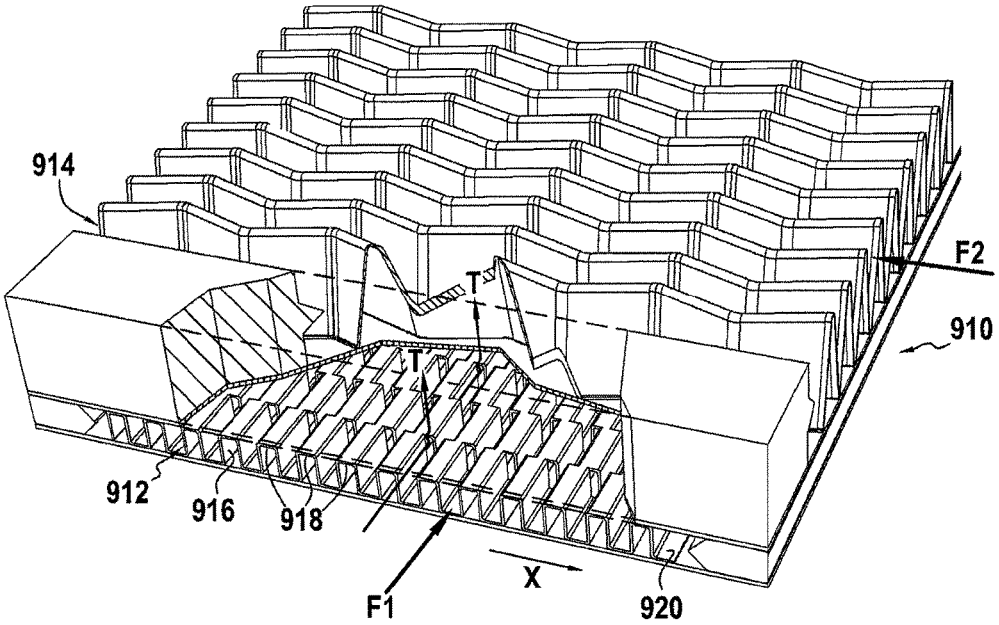
FIG.1 PRIOR ART
FIG. 1 shows a heat exchange module of the prior art.
Figure 2:
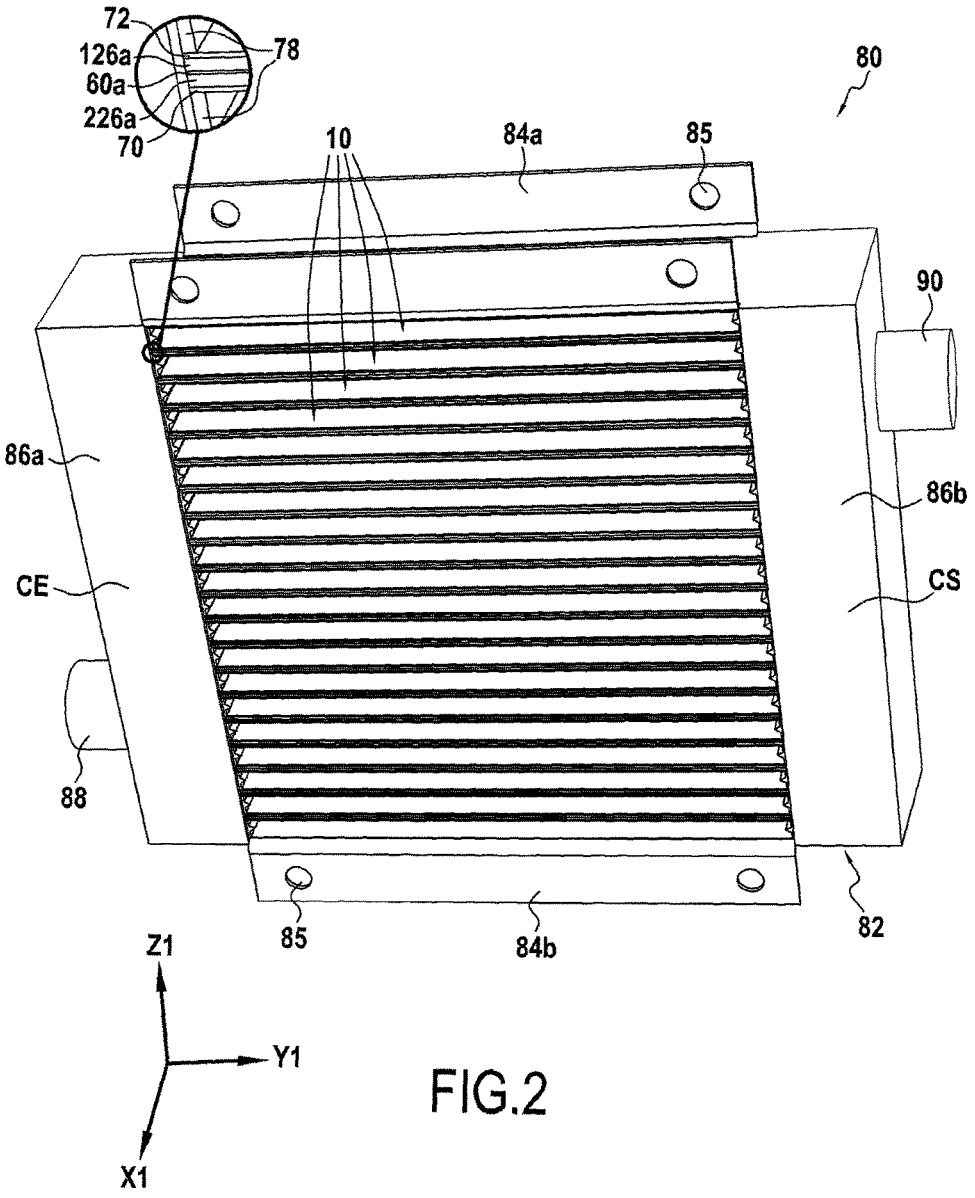
FIG. 2 is an overall view of a heat exchanger in an embodiment of the invention.

FIG. 2 shows a heat exchanger 80 in an embodiment of the invention, comprising a plurality of heat exchange modules 10 stacked in a transverse direction Z1.

In this example, the stack is surrounded by a frame 82 having two longitudinal sides 84*a* and 84*b* with fastener means 85, and two other sides 86*a* and 86*b* extending in the transverse direction Z1 and defining respectively an inlet manifold CE having at least one inlet 88, and an outlet manifold CS having at least one outlet 90 for a fluid that is to be cooled.

In the example shown, each heat exchange module 10 comprises a cell for passing a flow of said fluid for cooling (also referred to herein as a flow cell) extending in the longitudinal direction Y1 of the heat exchanger 80 from the inlet manifold CE to the outlet manifold CS.

In addition, each module 10 has a cell for passing a flow of a cooling fluid (also referred to herein as a second flow cell) that is open to the outside at both of its opposite ends in the lateral direction of the heat exchanger.

Figure 3:
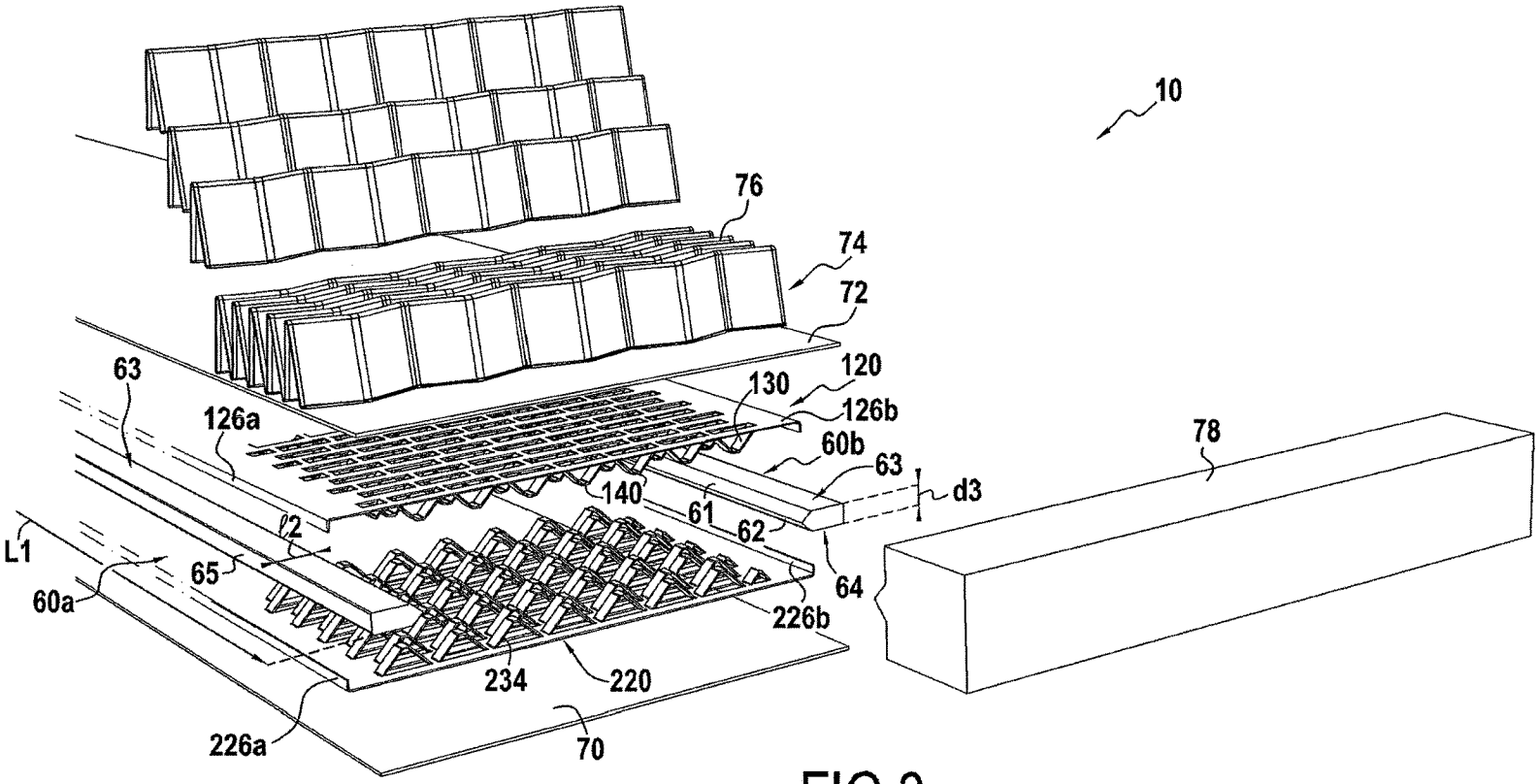
FIG. 3 is an exploded view of a heat exchange module contained in the FIG. 2 heat exchanger.

As shown in FIG. 3, each first flow cell is defined by first and second separator plates 70 and 72 that are spaced apart by a first pair of spacers 60*a* and 60*b*. A frame 16 (see FIGS. 7A and 7B) of the present invention serves to guarantee that inside space is defined between these various elements.

Each second flow cell is defined by a second pair of spacers 78 (only one of which is shown in FIG. 3), and it houses a block of fins 74.

The various elements of the heat exchange module 10 may be fastened to one another by welding and/or soldering techniques that are themselves known and not described in detail herein.

It should be observed that the heat exchanger in the example described is not limiting in any way on the present invention. Thus, a heat exchanger of the invention may present any other appropriate configuration. For example, the fluid to be cooled and the cooling fluid may flow along paths that are not perpendicular, but that are parallel, in opposite directions, or in the same direction.

There follows a description in greater detail of a frame 16 of the invention that is for placing within a flow cell of a heat exchange module, as mentioned above.

Such a frame 16 is made up of two similar plates 20 (referred to below as finned plates) that are nested one in the other.

In order to clearly understand the structure of the frame 16, it is therefore necessary to begin by describing the structure of one of the finned plates 20. This is done below with reference to FIGS. 4 and 5.

Figure 4:
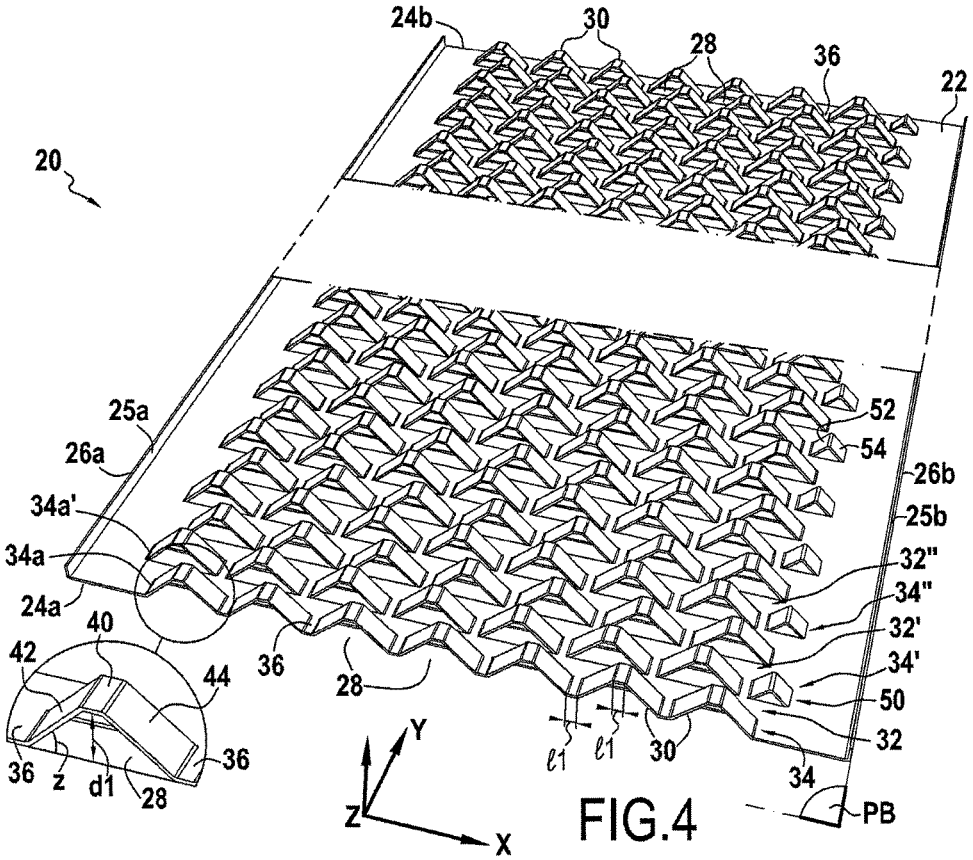
FIGS. 4 and 5 are fragmentary perspective views of a finned plate in a first embodiment, seen respectively from above and from below.

As shown in FIG. 4, a finned plate 20 has a base 22 of generally rectangular shape, and defined in a base plane PB.

Figure 5:
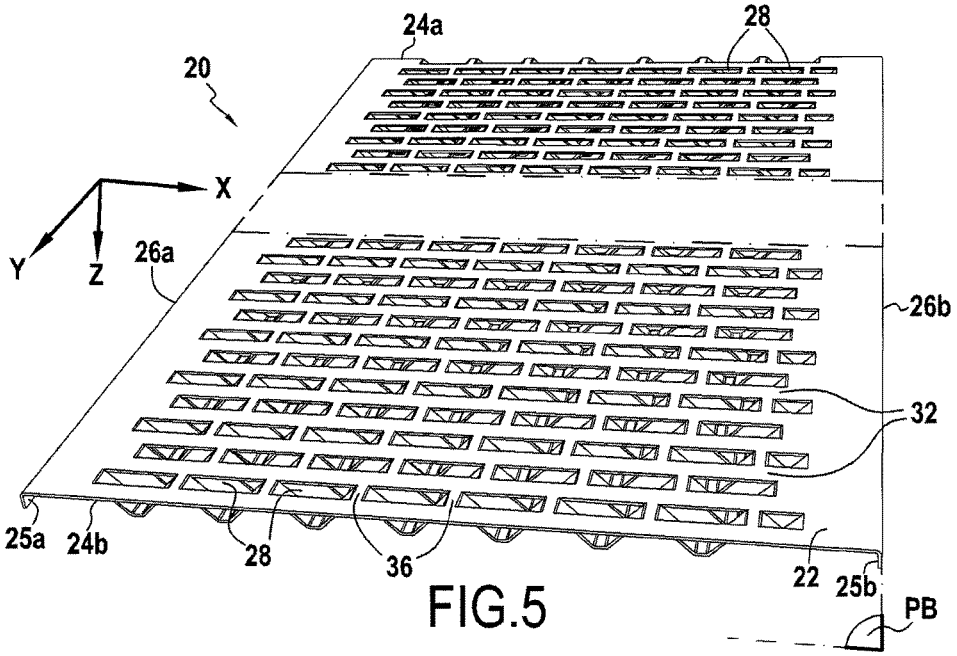

Thereafter, a lateral direction X of the finned plate 20 is defined along which its short sides 24*a* and 24*b* extend, as is a longitudinal direction Y along which its long sides 26*a* and 26*b* extend, and finally a transverse direction Z is defined that is normal to the base plane PB. To simplify the figures, only a portion of the plate 20 is shown in FIGS. 4 and 5. As indicated by dashed lines, the plate continues in identical manner in the longitudinal direction Y.

With reference to the heat exchanger 80 of FIG. 2, the longitudinal direction Y of the finned plate 20 included in this heat exchanger is parallel to the longitudinal direction Y1 of the heat exchanger 80. Likewise, the lateral direction X of the finned plate 20 is parallel to the lateral direction X1 of the heat exchanger 80. Finally, the transverse direction Z of the finned plate is parallel to the transverse direction Z1 of the heat exchanger 80.

As shown in FIG. 5, the base 22 has a plurality of substantially rectangular openings 28 arranged in parallel rows extending in the lateral direction X. With reference to FIG. 4, it can be understood that each of these openings has a fin 30 overlying it, the fin extending from the base 22 in the transverse direction Z.

Each fin 30 is thus a continuous piece that does not coincide with the base, but that is connected thereto via two ends.

In other words, the finned plate 20 has a plurality of undulating strips 34 or strips 34 of fins that are spaced apart from one another by continuous flat base strips 32, which are all of the same width in this example (measured in the longitudinal direction Y of the plate) and which extend over the entire or substantially the entire length of the plate. As can be seen in FIGS. 4 and 5, all of the fins 30 project to the same side of a finned plate, while its opposite side remains generally plane.

Such a plate 20 may be obtained for example by simultaneously punching and embossing a plane metal sheet.

Within a given strip 34 of fins, two adjacent fins 30 are spaced apart from each other by a portion coinciding with the base 22 and referred to as an intermediate portion 36.

As can be seen in FIG. 4, nearly all of the fins 30 present the same isosceles trapezoid profile.

Each of them thus has a first sloping wall 42 and a second sloping wall 44 sloping in the opposite direction to the first, these two walls being interconnected by a junction portion 40 that is parallel to the base plane PB and spaced apart from said base plane PB by a predetermined distance dl corresponding to the total thickness of the finned plate 20. In the example shown, both sloping walls 42 and 44 slope at an angle z of 45° relative to the base plane PB. In addition, in this example, the junction portion 40 has the same length as the above-mentioned intermediate portion 36.

Figure 6:
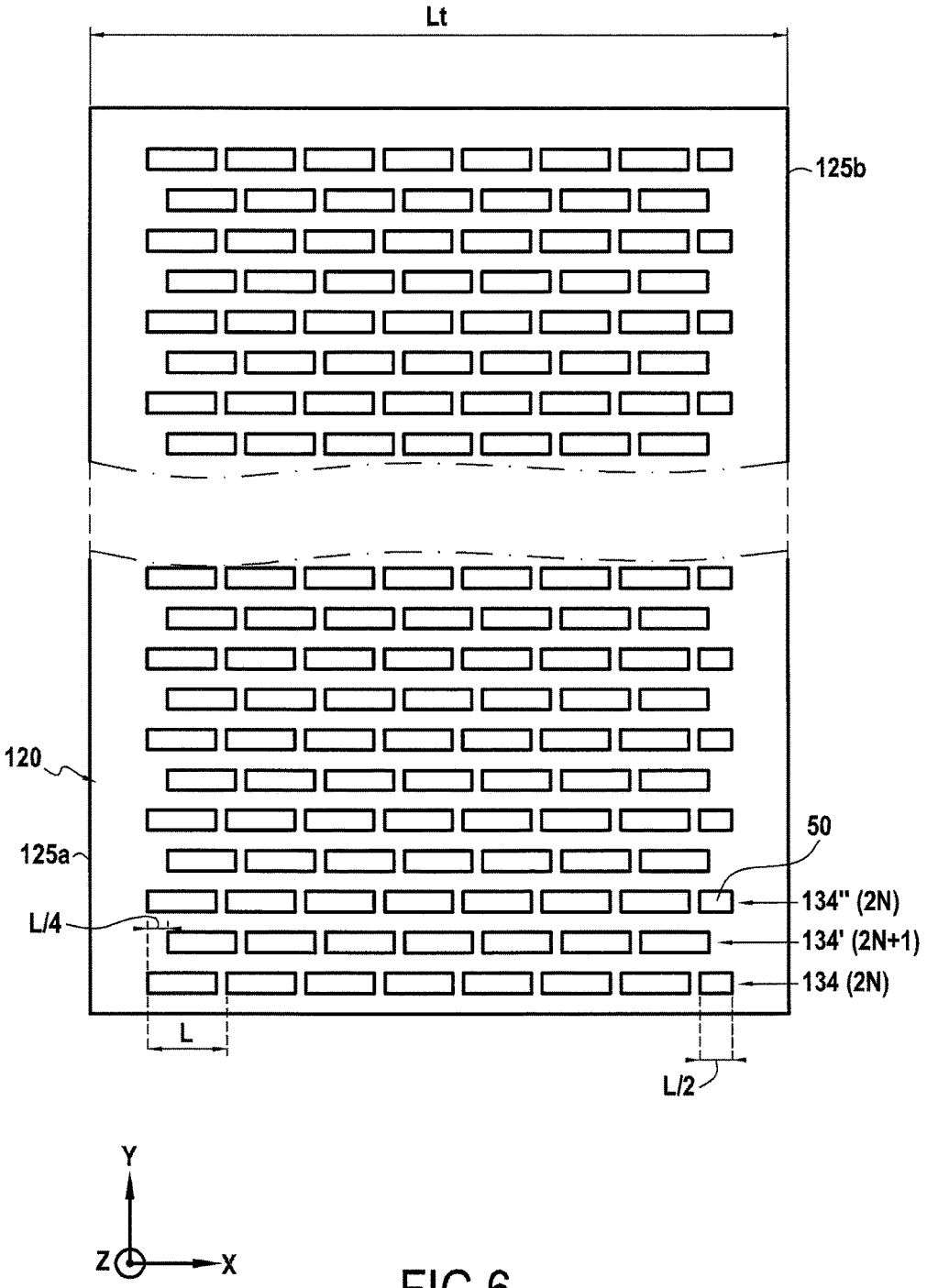
FIG. 6 shows the finned plate of FIGS. 4 and 5 in plan view.
Figure 7A:
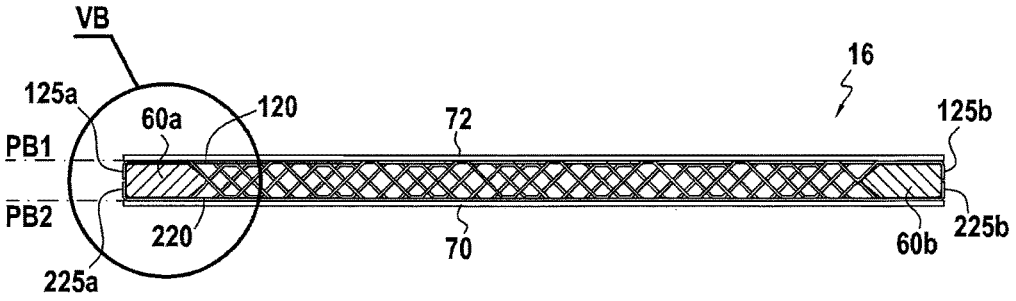
Figure 8:
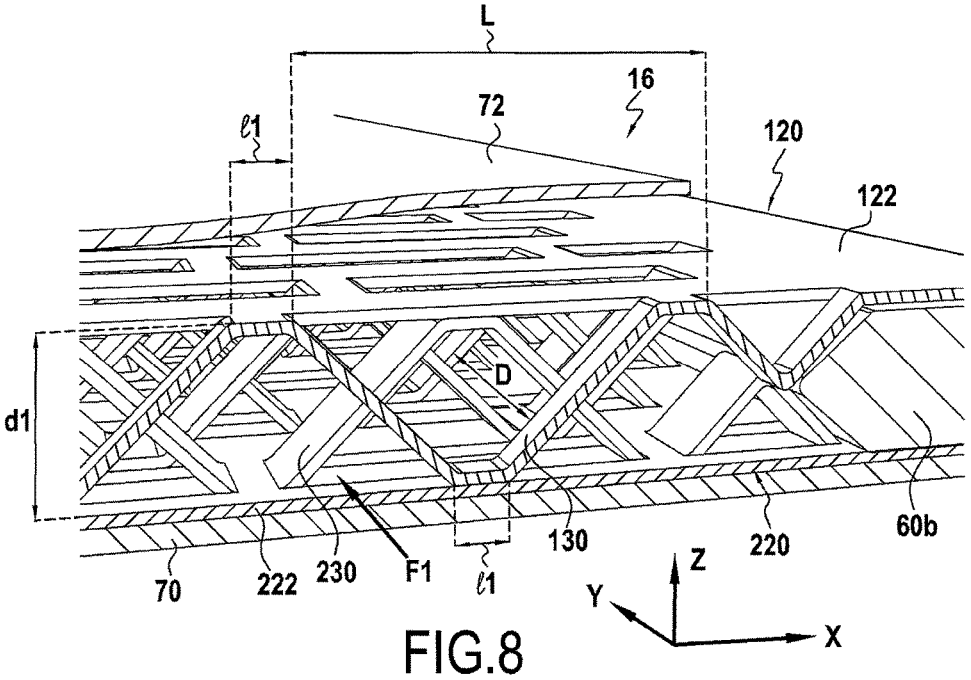
FIG. 8 shows in greater detail how the fins are arranged in the frame of FIGS. 7A and 7B.
Figure 7B:
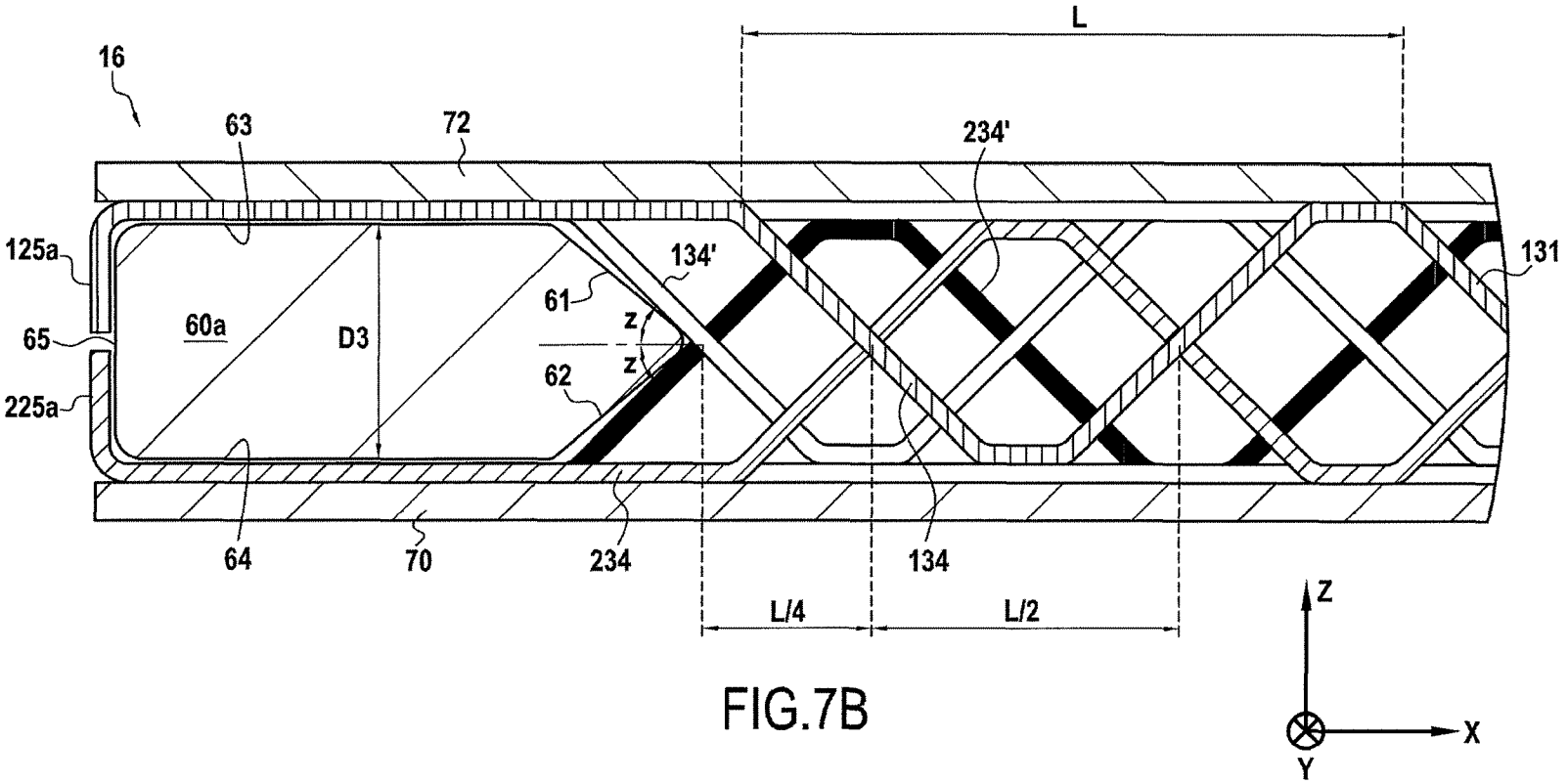

In an aspect of the invention, two similar finned plates 120 and 220 having the shape of the plate 20 described above are assembled together so as to form a frame 16 of the type shown in FIGS. 7A, 7B, and 8. The elements described above with reference to the finned plate 20 have the same numerical references in FIGS. 6 to 10, possibly plus 100 or plus 200 depending on which one of the two finned plates 120 and 220 is involved.

FIG. 6 shows such a plate 120 seen from above, and it can be seen that the strips of fins of rank 2N (where N is an integer) all present a configuration that is identical. In particular, each fin in each strip of fins of rank 2N is in alignment in the longitudinal direction Y with a fin in each other strip of rank 2N.

Also in FIG. 6, it can be seen that the strips of fins of rank 2N+1 (N being an integer) are all offset in the lateral direction X, relative to the strips of rank 2N.

This offset in the lateral direction X between the strips of rank 2N and the strips of rank 2N+1 is equal in this example to one-fourth of the length L of a fin, as measured in that lateral direction X.

Still with reference to FIG. 6, it can be seen that all of the strips of rank 2N present the same length, which is longer than the length of the strips of rank 2N+1. In the example, each of the strips of rank 2N has an additional fin portion 50 at one end. Each of these fin portions is folded relative to the base plane so as to have a triangular profile 50, as shown in FIG. 4. Also in FIG. 6, it can be seen that said fin portion has a length equal to L/2, in other words half the length of a fin.

Finally, two strips of fins of ranks 2N and 2N+1, that are immediately adjacent, are spaced apart in the longitudinal direction Y by a distance that is not less than the width of a strip of fins in that direction Y.

The above-mentioned configuration is such that two finned plates 120 and 220 of the above-described type can be arranged head-to-toe so as to constitute a frame 16.

In this position, the first long side 126*a* of the first finned plate 120 faces the second long side 226*a* of the second plate 220, and the second long side 126*b* of the first finned plate 120 faces the first long side 226*b* of the second plate 220 (see FIG. 3).

Furthermore, the junction portions 140 of the fins 130 of the first finned plate 120 face the flat strips 232 of the second finned plate 220, and vice versa.

The configuration obtained is shown in FIGS. 7A, 7B, 8, 9, and 10.

Figure 9:
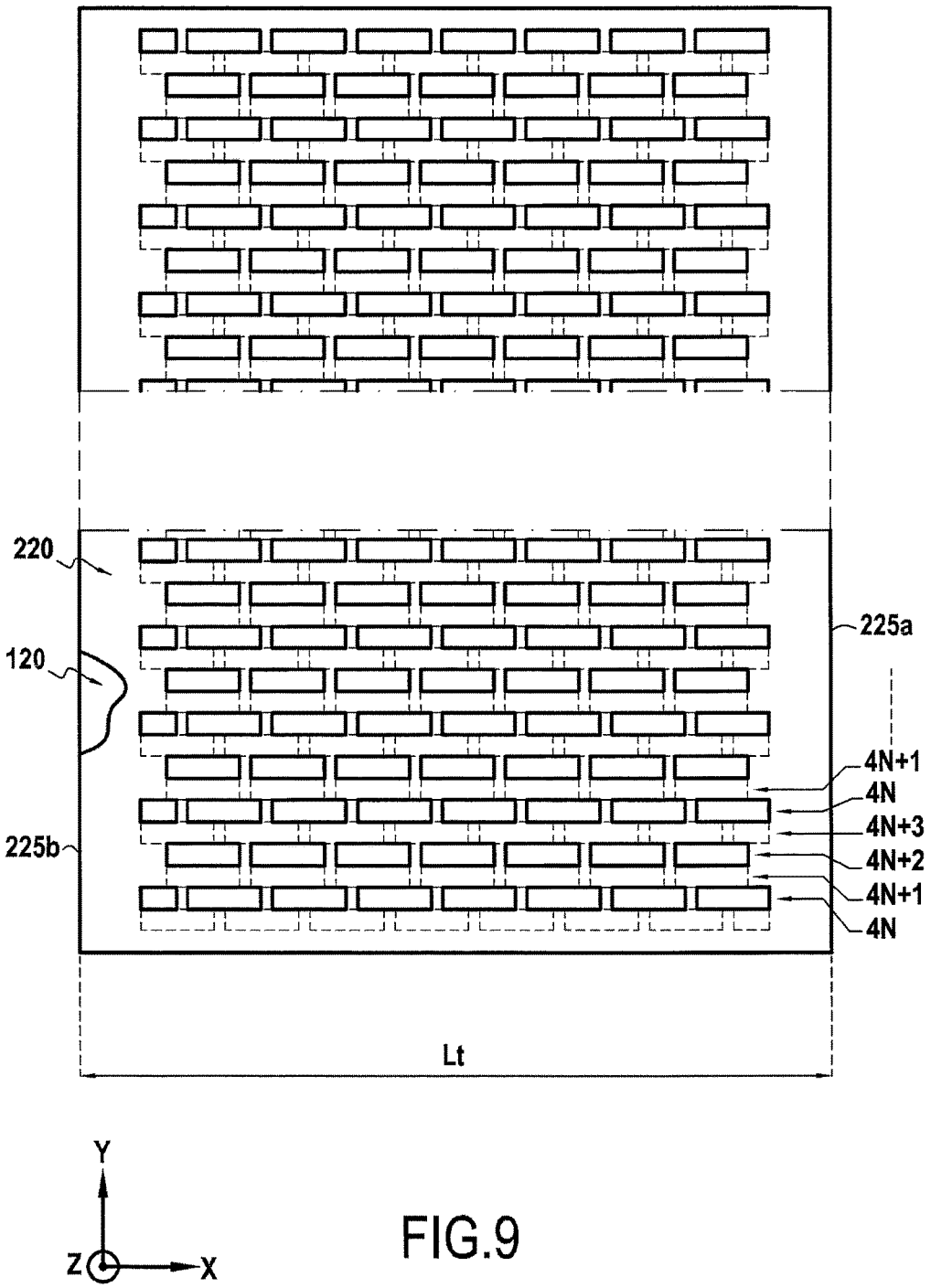
FIG. 9 shows the FIG. 8 frame seen from above.

With reference to FIG. 9, if the strips of fins of both finned plates are counted together, the fins of strips of rank 4N are mutually in alignment in the longitudinal direction Y, and likewise the fins of strips of rank 4N+1 are offset relative to the fins of strips of rank 4N by a distance L/4 in the lateral direction X, the fins of strips of rank 4N+2 are offset relative to the fins of strips of rank 4N by a distance L/2, and the fins of strips of rank 4N+3 are offset relative to the fins of strips of rank 4N by a distance 3L/4.

Figure 10:
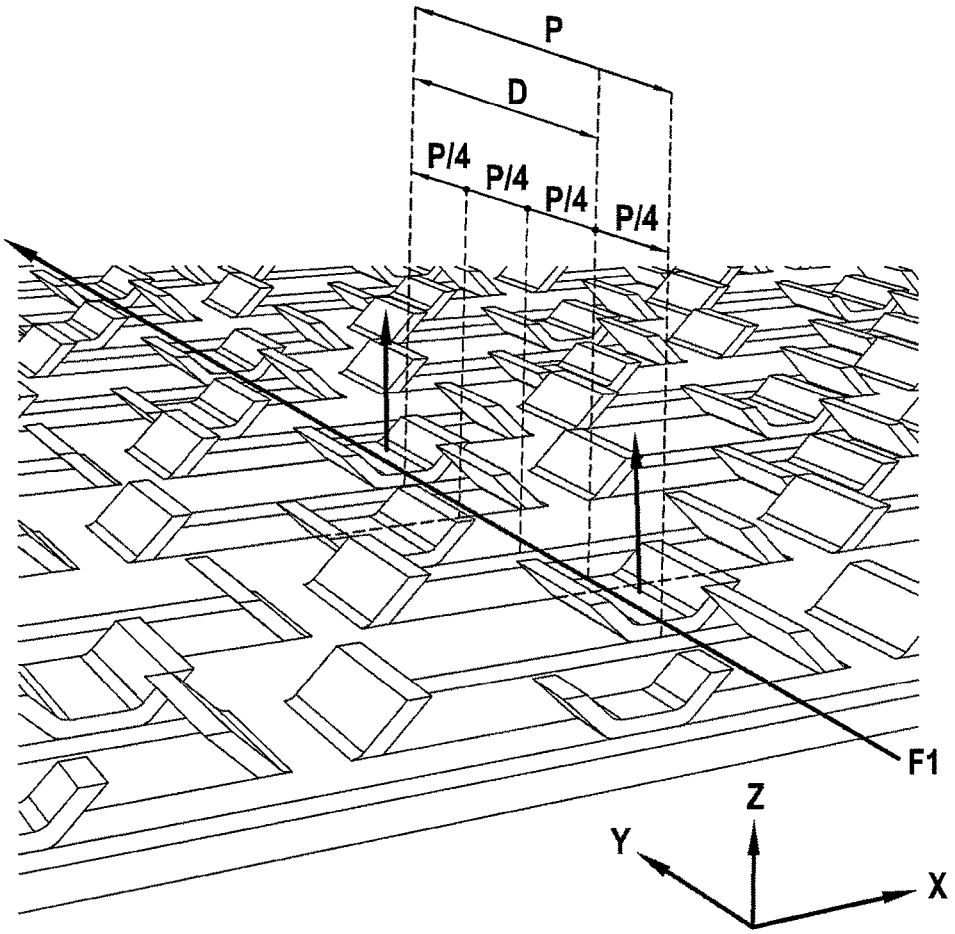
FIG. 10 is a fragmentary section view of the FIG. 8 frame.

In FIGS. 8 and 10 in particular, it can be seen that the fin branches of the same orientation appear in the longitudinal direction Y with a periodicity of 4. In other words, two fin portions of the same orientation are in alignment in the longitudinal direction Y once every four strips of fins. In the figure, the distance between two successive fin branches of the same orientation in the longitudinal direction Y is written D, and D is equal to three times the width of a fin strip in this example.

In other words, a fluid F passing through the frame 16 in the longitudinal direction Y encounters in succession (when considering width portions of a strip of fins): a fin, then nothing, nothing, nothing, a fin, nothing, nothing, nothing, a fin, etc.

In other words, a sheet of fluid having the same cross-section as a fin and flowing in the direction F passes closest to fins of rank 4N in the longitudinal direction Y.

Such provisions make it possible to reduce pressure losses inside the frame 16 considerably compared with prior art devices that operate in an on/off mode, i.e. with a periodicity of 2. In such known devices, the fluid is in contact with the fins over half of its travel. However, the fins constitute a major brake to the flow, thereby leading to a loss of pressure in the fluid. The quantity of energy that needs to be deployed for given efficiency is thus much greater.

In other embodiments of the invention, the periodicity of the fins inside the frame 16 may be other than four, and in particular it may be greater than four. The value of the offset of the fins may also be selected as a function of the fluid in question.

From FIG. 7A, it can be seen that two finned plates 120 and 220 are held in position inside the heat exchange module 10 by means of two spacers 60*a* and 60*b* that are sandwiched between said plates.

As shown in FIG. 3, each spacer 60*a* and 60*b* is in the form of an elongate element having a first bearing face 63 and a second bearing face 64, which bearing faces are opposite and parallel, being spaced apart from each other by a distance d3. These two bearing faces present a length L1 substantially equal to the length of the heat exchanger 80 in which the frame 16 is to be incorporated (see FIG. 2), and a width l2 that is sufficient to ensure that it presses firmly against the bases of the first and second finned plates.

The two bearing faces 63 and 64 of a spacer 60*a* or 60*b* are connected together by a side of V-shaped profile that is to point towards the inside of the fluid flow cell. The faces 61 and 62 forming the V-shaped profile slope relative to the bearing faces 63 and 64 of the spacer at an angle equal to the angle of inclination Z of the fin walls 42 and 44, i.e. 45° in this example. The side 65 remote from the V-shaped profile extends perpendicularly to the two bearing faces 63 and 64.

In the example shown, each finned plate 20 includes, at each of its lateral ends 126*a*, 126*b*, 226*a*, 226*b*, a respective edge 125*a*, 125*b*, 225*a*, or 225*b* that is folded perpendicularly to the base 22 and that is of constant height over the entire width of the finned plate 20.

Each folded edge 125*a*, 125*b*, 225*a*, 225*b* presses against the side 65 of a spacer 60*a* or 60*b*. In preferred manner, the height of the folded edges on each finned plate is selected to be at least a little less than half the thickness d3 of the spacer, such that the respective facing edges of the two finned plates 120 and 220 do not overlap.

It should be recalled that the assembly made up of the spacers 60*a* and 60*b* together with the finned plates 120 and 220 is mounted between two separation plates 70 and 72 as described above with reference to FIG. 4.

The shape of the fins, and in particular their sloping walls 42 and 44 gives them a certain amount of springiness, thereby making it possible to reduce dimensional constraints when assembling between the separation plates 70 and 72. In the event of the height of the fins being initially slightly greater than the thickness of the spacers 60*a* and 60*b*, the sloping portions of the fins bend when the plates 70 and 72 are moved towards each other so as to come into contact with the bearing faces of the spacers.

A frame 116 in a second embodiment of the present invention is described below with reference to FIGS. 11 and 12.

Figure 11:
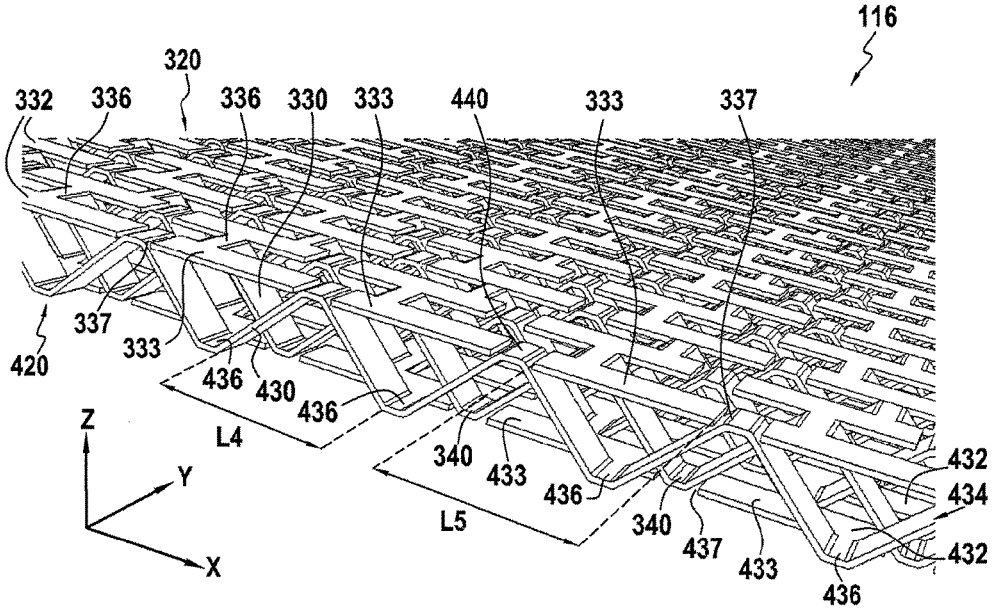
FIG. 11 shows a frame in a second embodiment of the invention, seen in perspective.

FIG. 11 shows two finned plates 320 and 420 in this second embodiment that are nested one within the other as in the above-described embodiment, and together they form a frame 116. The elements described above with reference to the finned plates 20, 120, and 220 are given the same numerical references as in FIGS. 6 to 10, possibly increased by 100 or 200 depending on which one of the finned plates 320 and 420 is involved.

Unless specified to the contrary, all of the provisions described above for the first embodiment of FIGS. 2 to 10 remain applicable to this second embodiment.

In this example, each finned plate 320 and 420 is characterized in that two adjacent strips of fins in a given plate are spaced apart by a discontinuous flat strip 332 or 432 formed by an alignment of flat segments 333 or 433 alternating with openings 337 or 437. As shown in FIG. 11, the segments 333 and 433 generally present a shape L5 that is substantially equal to the length L4 measured between two intermediate modules 336 or 436 of a strip of fins.

It should also be observed that the flat segments 333 and 433 of adjacent rows are offset relative to one another so as to accommodate the offset of the fins, as described with reference to the first embodiment and not repeated for this embodiment.

Such a finned plate 320 or 420 is obtained by cutting out a metal plate and then folding in order to obtain the fins. Unlike the above-described embodiment, no embossing operation is needed.

Figure 12:
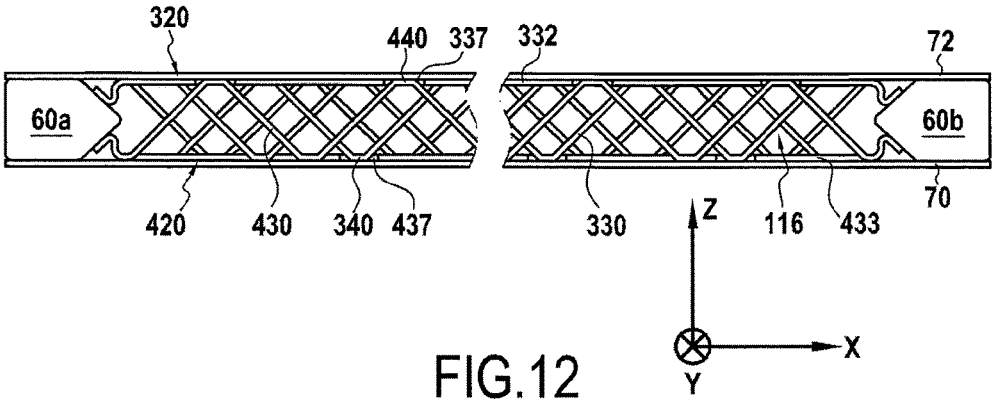

As shown in FIGS. 11 and 12, once the two finned plates 320 and 420 are nested one within the other, the fins 430 of the second finned plate 420 are positioned facing flat strips 332 of the first finned plate 320, the junction portion 440 of each fin 430 of the second plate 420 being placed between two strip segments 333 of the first plate 320, in an opening 337.

In the same manner, the fins 330 of the first finned plate 320 are positioned facing flat strips 432 of the second finned plate 420, the junction portion 340 of each fin 330 of the first plate 320 being placed between two strip segments 433 of the second plate 420 in an opening 437.

FIG. 12 shows a frame 116 mounted between two separator plates 70 and 72 of the type shown in FIG. 3.

Unlike the first embodiment as described above, it can be seen that the separator plates 70 and 72 are directly in contact with the spacers 60*a* and 60*b*.

It can also be seen that once the frame 116 is mounted between the two plates 70 and 72, the fins of the two finned plates are compressed a little in the transverse direction Z, such that the junction portions 340 and 440 of the fins, positioned in the openings 337 and 437 as described above, come to bear respectively against the second separator plate 72 and the first separator plate 70. To obtain better overall energy efficiency, the intermediate portions 336 and 436, and/or the junction portions 340 and 440 may be fastened to the junction plates against which they come to bear respectively, in particular by soldering or welding.

The invention claimed is:

1. A frame comprising two finned plates, wherein each finned plate comprises a base and a plurality of heat exchange fins extending from said base, said fins being distributed over at least two strips of fins, being mutually parallel, wherein two adjacent strips of fins among the strips of fins are separated in a direction perpendicular to the direction of said strips of fins by a flat strip not having any fins, wherein each fin has two distinct ends secured to the base, wherein the base has an opening between the respective ends of each fin, and wherein the finned plates are nested together in such a manner that the fins of the first finned plate are inserted in facing spaces of flat strips of the second finned plate and are arranged head-to-toe relative to the adjacent fins of the second finned plate;

wherein two adjacent strips of fins are separated by a discontinuous flat strip formed by a succession of segments spaced apart by openings.

2. A frame according to claim 1, wherein, with the finned plates nested together, two fin portions having the same orientation are in alignment in a direction perpendicular to the strips of fins and parallel, to the bases of the finned plates, once every K strips of fins, where K is an integer greater than 2.

3. A frame according to claim 1, wherein said flat strip presents a width that is not less than the width of a strip of fins.

4. A frame according to claim 1, wherein a fin portion is defined between said ends, said fin portion being a continuous single piece that does not coincide with said base.

5. A frame according to claim 1, wherein each heat exchange fin includes at least one curved portion or at least one sloping portion sloping relative to the base.

6. A frame according to claim 1, wherein two adjacent fins of two adjacent strips of fins are offset relative to each other in the direction of said strips of fins.

7. A frame according to claim 1, wherein two adjacent strips of fins belonging respectively to the two finned plates are offset relative to each other in the direction of said strips of fins.

8. A frame according to claim 1, wherein two fin portions having the same orientation are in alignment in a direction perpendicular to the strips of fins and parallel to the bases of the finned plates, once every K strips of fins, where K is an integer equal to 4.

9. A frame according to claim 1, wherein each fin has a portion that is parallel to said base and spaced apart from said base.

10. A heat exchanger comprising:

a stack of heat exchange modules, wherein each module has a flow cell for a fluid that is to be cooled and a flow cell for a cooling fluid, wherein the modules are side by side and thermally coupled together, wherein the flow cell for the fluid that is to be cooled and/or the flow cell for the cooling fluid includes a frame, the frame including two finned plates, wherein each finned plate comprises a base and a plurality of heat exchange fins extending from said base, said fins being distributed over at least two strips of fins, being mutually parallel, wherein two adjacent strips of fins among the strips of fins are separated in a direction perpendicular to the direction of said strips of fins by a flat strip not having any fins, wherein each fin has two distinct ends secured to the base, wherein the base has an opening between the respective ends of each fin, and wherein the finned plates are nested together in such a manner that the fins of the first finned plate are inserted in facing spaces of flat strips of the second finned plate and are arranged head-to-toe relative to the adjacent fins of the second finned plate, wherein two adjacent strips of fins are separated by a discontinuous flat strip formed by a succession of segments spaced apart by openings.

11. A heat exchanger comprising at least a frame, the frame including two finned plates, wherein each finned plate comprises a base and a plurality of heat exchange fins extending from said base, said fins being distributed over at least two strips of fins, being mutually parallel, wherein two adjacent strips of fins among the strips of fins are separated in a direction perpendicular to the direction of said strips of fins by a flat strip not having any fins, wherein each fin has two distinct ends secured to the base, wherein the base has an opening between the respective ends of each fin, and wherein the finned plates are nested together in such a manner that the fins of the first finned plate are inserted in facing spaces of flat strips of the second finned plate and are arranged head-to-toe relative to the adjacent fins of the second finned plate;

wherein two adjacent strips of fins are separated by a discontinuous flat strip formed by a succession of segments spaced apart by openings.

* * * * *